US005167083A

United States Patent [19]

Walkhoff

[11] Patent Number: 5,167,083

[45] Date of Patent: Dec. 1, 1992

[54] SKI BOOT WITH AN ARTICULATED TONGUE PART

[75] Inventor: Klaus Walkhoff, Kreuzlingen, Switzerland

[73] Assignee: Raichle Sportschuh AG, Kreuzlingen, Switzerland

[21] Appl. No.: 851,255

[22] Filed: Mar. 13, 1992

Related U.S. Application Data

[63] Continuation of Ser. No. 588,094, Sep. 24, 1990, abandoned.

[30] Foreign Application Priority Data

Sep. 26, 1989 [CH] Switzerland ..... 03484/89

[51] Int. Cl.[5] ..... A43B 5/04

[52] U.S. Cl. ..... 36/117; 36/120; 36/121; 36/50.5

[58] Field of Search ..... 36/117-121, 36/50, 54; 24/685 K

[56] References Cited

U.S. PATENT DOCUMENTS

| | | | |
|---|---|---|---|
| 3,793,749 | 2/1974 | Gertsch et al. | 36/2.5 AL |
| 4,281,468 | 8/1981 | Giese et al. | 36/121 |
| 4,593,483 | 6/1986 | Paris | 36/119 |
| 4,631,839 | 12/1986 | Bonetti et al. | 36/50 |
| 4,769,930 | 9/1988 | Morell et al. | 36/117 |
| 4,777,742 | 10/1988 | Petrini et al. | 19/120 |
| 4,811,503 | 3/1989 | Iwama | 36/119 |
| 4,841,649 | 6/1989 | Baggio et al. | 36/117 |
| 4,922,635 | 5/1990 | Zanco | 36/120 |
| 4,937,953 | 7/1990 | Walkoff | 36/119 |

FOREIGN PATENT DOCUMENTS

| | | | |
|---|---|---|---|
| 0015862 | 9/1980 | European Pat. Off. | 36/117 |
| 0053340 | 9/1982 | European Pat. Off. | 36/117 |
| 316540 | 5/1989 | European Pat. Off. . | |
| 1963342 | 6/1971 | Fed. Rep. of Germany . | |
| 2341658 | 3/1974 | Fed. Rep. of Germany . | |
| 2593682 | 8/1987 | France . | |
| 81/00507 | 3/1981 | World Int. Prop. O. . | |

*Primary Examiner*—Paul T. Sewell
*Assistant Examiner*—Thomas P. Hilliard
*Attorney, Agent, or Firm*—Collard & Roe

[57] ABSTRACT

Guide orifices for the clamping cables are provided above the joint on the heel part of the ski boot. The tongue part has guide eyelets in lateral rear end regions and passages approximately centrally between these guide eyelets and the longitudinal mid-plane of the boot. The clamping cables starting from the clamping device extend correspondingly from the guide orifices to the guide eyelets and under the tongue part to the respective passages. Between the passages, the clamping cables are guided over the tongue part. Their ends on this side are secured to the shell part at fastening points covered by the tongue part. The clamping cables constitute a guide for the tongue part, so that the ski boot can be closed solely by tightening the clamping cables by means of the clamping device.

11 Claims, 6 Drawing Sheets

FIG. 6
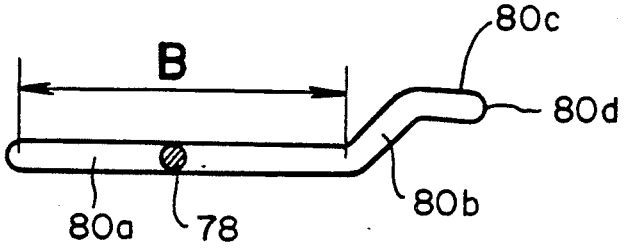
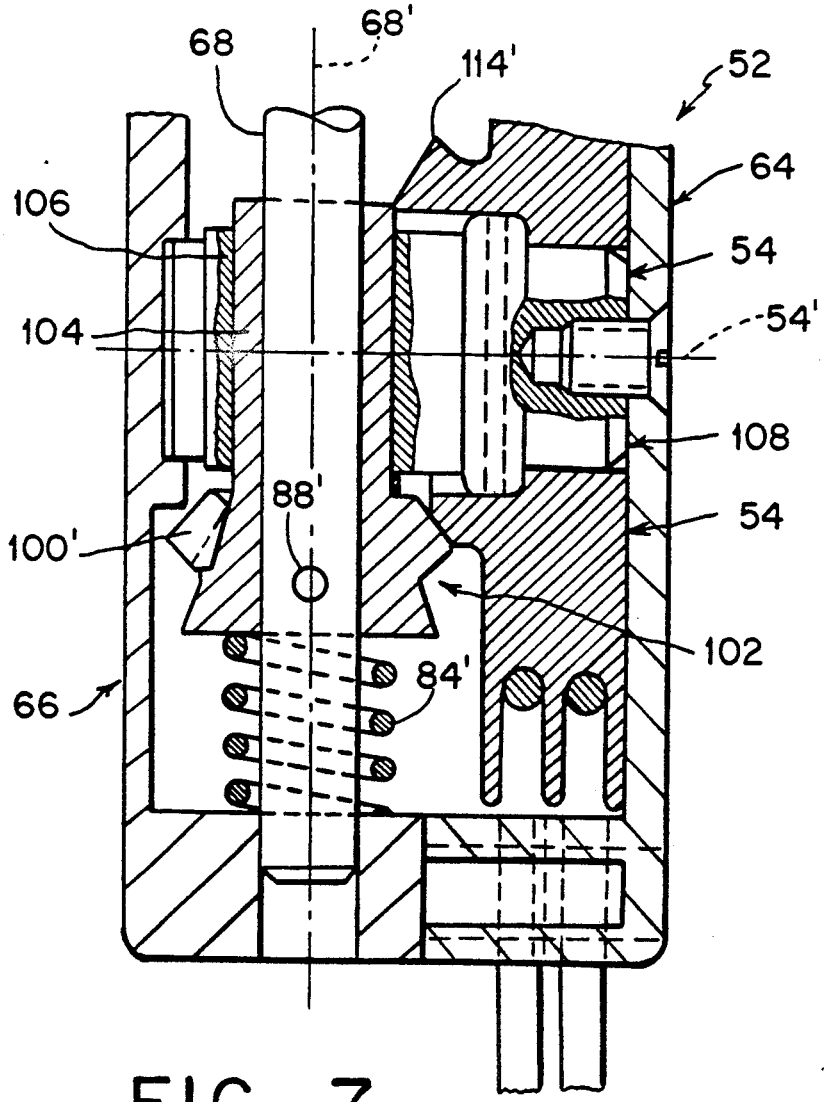
FIG. 7

SKI BOOT WITH AN ARTICULATED TONGUE PART

This is a continuation of copending application Ser. No. 07/588,094 filed on Sep. 24, 1990, now abandoned.

BACKGROUND OF THE INVENTION

1. Field of the Invention

The present invention relates to a ski boot with a shell part equipped with a sole.

2. The Prior Art

Such a ski boot is known, for example, from U.S. Pat. No. 4,281,468. This has a shell part which is equipped with a sole and encloses the entire foot region and which possesses lateral tongue-shaped tabs projecting upwards in the leg region. The shell part is cut out in the instep region and in the instep/shin region is covered in a saddle-like manner by a tongue part which is fastened to the shell part in the toe region by means of a rivet approximately in the longitudinal mid-plane of the boot. For entry into and exit from the ski boot, the tongue part is pivoted forwards. Articulated on the lateral tabs above the ankle is a heel part. This surrounds the leg in the region between the ankle and the calf and, when the lower leg bends forwards, is forwardly pivotable out of a position of rest which corresponds to the customary travelling position. The tongue part is of wave-shaped design, and the portions of three clamping-cable loops extend over it in the wave troughs. A first clamping-cable loop is secured to the outside of the shell part on the inside of the ski boot, extends over the tongue part in the instep region and can be suspended on a clamping lever fixed to the outside of the ski boot. A second clamping-cable loop extends over the tongue part in the transitional region between the instep and shin, the clamping-cable loop being secured to the shell part on the inside of the ski boot in the region of the ankle, and the corresponding clamping lever being located on the outside of the ski boot, likewise in the region of the ankle. The third clamping-cable loop engages round the tongue part and heel part in the region of the shin, the respective clamping lever being fastened to the heel part on the outside of the ski boot. By tightening the clamping-cable loops, the shell part is matched to the foot region and lower leg region of the skier, so that no further adjustable and lockable holding elements are needed inside the ski boot. Although this known ski boot certainly gives the skier a very firm hold, the opening and closing of the ski boot and the setting of the correct tension of the clamping-cable loops nevertheless involves a great deal of labor. Since, in the known ski boot, the shell part is matched to the anatomy of the foot, high clamping forces are required, and this makes it more difficult to pivot the clamping levers.

Furthermore, a so-called rear-entry ski boot is known from EP-A 0,053,340. This has a shell part covering the foot in the toe and instep region and having lateral tabs projecting upwards. The shell part is cut out in the instep region and in the instep/shin region is covered in a saddle-like manner by a tongue part. The tongue part, in the region of its tip, is connected to the shell part by means of a fastening element. A heel part is articulated on the shell part in the region of the heel by means of rotary joints and is rearwardly pivotable about the rotary joint out of a position of rest for the purpose of opening the ski boot. In order to close the ski boot, the heel part is pivoted forwards and braced relative to the upper end region of the tongue part by means of a clamping device. Fastened to the tongue part in each of its lateral end regions, at the transition between the instep region and shin region, is a steel band which extends in the direction of the heel to the respective rotary joint of the heel part. The steel band is connected, at its rear end, to a cable which extends round a deflection to a catch device provided on the heel part. When the ski boot is being closed by pivoting the heel part forwards, the cable is therefore tightened, with the result that the tongue part is pulled back in the direction of the heel, in order to give the skier a firm hold in the ski boot. When the heel part is being swung rearwards in order to open the ski boot, the tongue part is released in the forward direction. In this known ski boot, the shell part and tongue part are matched to the anatomy of the skier's foot in a way convenient to operate, but this principle is unsuitable for front-entry ski boots.

SUMMARY OF THE INVENTION

An object of the present invention is, therefore, to provide a ski boot of the particular generic type, which, while preserving the good match of the ski-boot shell to the skier's foot, guarantees a simpler operation for the closing and opening of the ski boot.

The above object is accomplished in accordance with the present invention by providing a ski boot comprising a shell part having a toe/instep region and equipped with a sole; a heel part mounted on the shell part so as to be forwardly pivotable out of a position of rest about an axis extending essentially parallel to the sole; a tongue part which is articulated on the shell part in the toe/instep region and which is forwardly pivotable for entry into and exit from the ski boot and which covers the shell part in the instep/shin region; a cable-like clamping element extending over the tongue part; a clamping device for the releasable clamping of the clamping element; the heel part articulated on the shell part in the region of the heel bone; a guide and a guide element; and the clamping element extending on both sides of the ski boot from the guide located on the heel part above its point of articulation on the shell part to the guide element, the guide element being on the tongue part in the lateral end regions of the latter at the transition between the instep region and shin region.

Because the heel part is articulated on the shell part in the region of the heel bone and the clamping element extends from a guide provided on the heel part above its point of articulation on the shell part to a guide element on the tongue part, in the lateral end regions of the latter at the transition between the instep region and shin region, only a single clamping element is necessary. When the ski boot is being closed, the cable-like clamping element constitutes a positive guide for the tongue, because the clamping element extending to the guide elements pulls the tongue part towards the guide on the heel part the more firmly, the more the clamping element is tightened by means of the clamping device. For closing the ski boot, therefore, it is necessary only to tighten the clamping element by means of the clamping device. The tongue part is pulled automatically into the correct position. Because the guide of the clamping element on the heel part is provided above the point of articulation of the latter on the shell part, when the ski boot is being closed the tongue part is pulled towards the heel part in the longitudinal direction of the boot, thereby also giving the skier a firm hold in the region of the shin.

BRIEF DESCRIPTION OF THE DRAWINGS

Other objects and features of the present invention will become apparent from the following detailed description considered in connection with the accompanying drawing which discloses two embodiments of the present invention. It should be understood, however, that the drawing is designed for the purpose of illustration only and not as a definition of the limits of the invention.

In the drawing wherein similar reference characters denote similar elements throughout the several views;

FIG. 6 shows a slot-shaped groove for the actuating element of the clamping device; and FIG. 7 shows part of a further embodiment of the clamping device.

DETAILED DESCRIPTION OF THE PREFERRED EMBODIMENT

Figure 1:
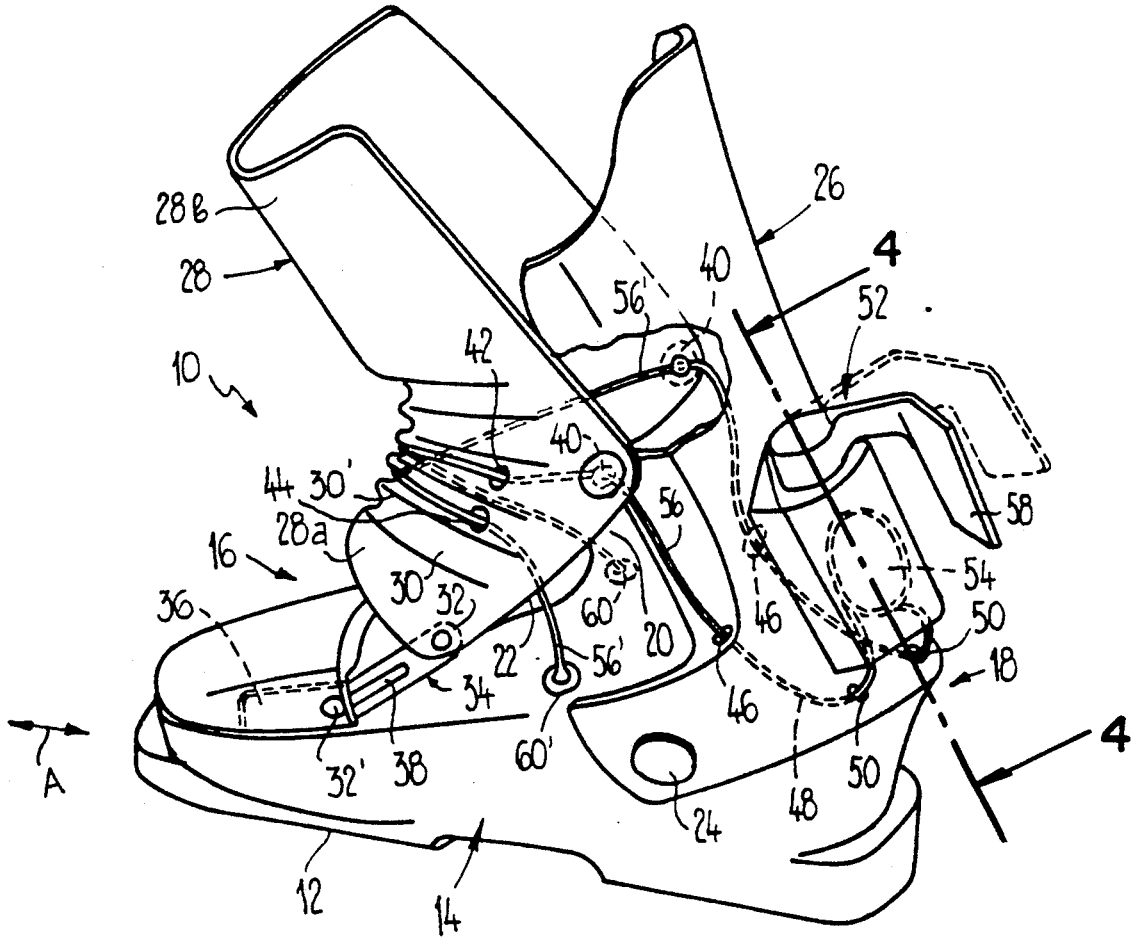
FIG. 1 shows a perspective view of an opened ski boot.
Figure 2:
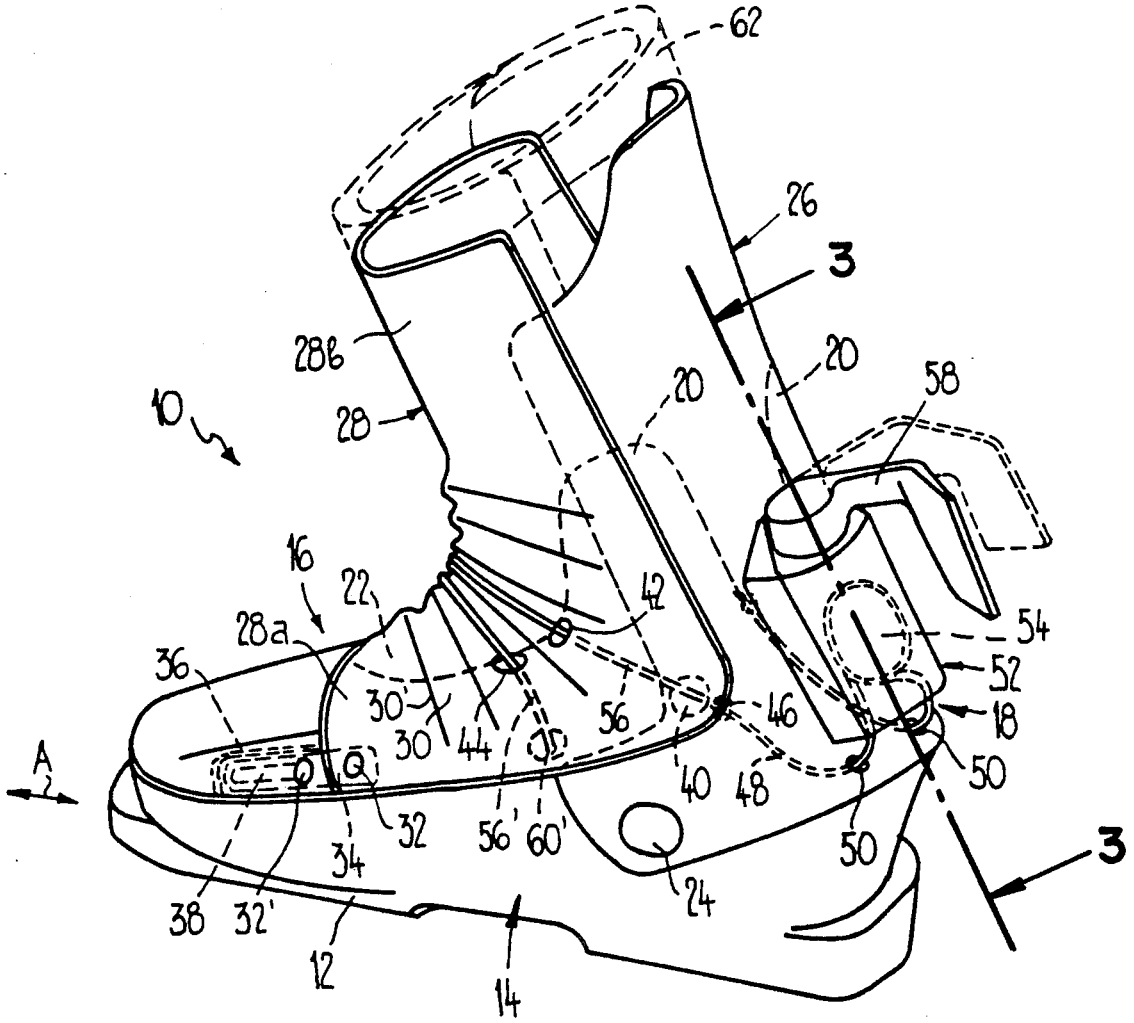
FIG. 2 shows a perspective view of a closed ski boot.

The plastic shell 10 of the ski boot illustrated in FIGS. 1 and 2 has a shell part 14 equipped with a sole 12. This shell part encloses the skier's foot in the toe and instep region 16 and in the lower heel region 18 and possesses two lateral tabs 20 projecting upwards in the ankle region. On its front side, a cutout 22 is provided on the shell part 14 in the region of the instep.

Fastened to the shell part 14 in the region of the heel bone by means of a joint 24 is a heel part 26. This surrounds the lower rear leg region between the lower heel region and the calf and engages laterally over the upwardly protecting tabs 20 of the shell part 14. When the lower leg bends forwards, the heel part 26 is forwardly pivotable out of the position of rest shown in the figures by means of an axis defined by the joint 24 and extending parallel to the sole 12 and at right angles to the longitudinal mid-plane of the boot. The position of rest of the heel part 26 corresponds to the normal posture of the lower leg during skiing.

Furthermore, the shell 10 possesses a tongue part 28 covering the instep/shin region 16, with a portion **28*a* covering the instep region and with a portion 28*b* covering the lower shin region. The tongue part 28 is of waveshape design in the portion 28*a* and in the transitional region between the two portions 28*a* and 28*b*, the wave troughs 30 and wave crests 30' extend from one side of the ski boot to the other. The tongue part 28, in its rear end regions, overlaps the heel part 26**.

The tongue part 28, in each of its two front lateral corner regions, is articulated pivotably on a strap 34 by means of rivets 32. The two straps 34, of which only one is visible in each of FIGS. 1 and 2, project forwards from the tongue part 28 and are guided displaceably approximately in the longitudinal direction A of the boot in corresponding pockets 36. The straps 34, in their region projecting from the tongue part 28, have guide slots 38 which extend in their longitudinal extension and through each of which extends a further rivet 32'. The rivet 32' is arranged on the shell part 14 in the open end region of the pockets 36. When the straps 34 are pulled out rearwards in the longitudinal direction A of the boot until the guide slots 38 butt against the rivets 32', these straps 34 are pivotable about the rivets 32', as shown in FIG. 1. In the position of the straps 34, the tongue part 28 is also in its rear end position. In contrast, when the straps 34 are pushed forwards partially or completely into the pockets 36 in the longitudinal direction A of the boot, they are guided so as to be displaceable in the longitudinal direction of the pockets 36. The straps 34 are no longer pivotable about the axis determined by the rivets 32' and extending approximately parallel to the sole 12 and at right angles to the longitudinal mid-plane of the boot (see FIG. 2). However, independently of the position of the straps 34, the tongue part 28 is pivotable on these about the axis determined by the rivets 32 and extending essentially parallel to the sole 12 and transversely relative to the longitudinal mid-plane of the boot.

A guide eyelet 40 is mounted freely rotatably on the tongue part 28 in each of the lateral rear corner regions at the transition from the portion **28*a* to the portion 28*b*. Approximately centrally between each of these guide eyelets 40 and the longitudinal mid-plane of the boot, the tongue 28 has a passage 42 in the transitional region between the portions 28*a* and 28*b*, these two passages 42 being located in the same wave trough 30. Two further passages 44 are provided in the next wave trough 30 forwards in the longitudinal direction A of the boot in relation to these passages 42**.

The heel part 26 has, above the joint 24 and offset rearwards, as seen in the longitudinal direction A of the boot, on each of the two sides a guide orifice 46, from which a diagrammatically indicated guide channel 48 extends, inside the heel part 26, into the rear lower end region of the heel part 26. The corresponding orifices at this end of the guide channels 48 are designated by 50. Above the orifices 50, a clamping device 52 with a drum-shaped winding-up element 54 for two clamping cables 56 and 56' is provided on the heel part 26. The clamping device 52 possesses a toggle-shaped actuating element 58 pivotable to and fro about an axis extending in the longitudinal mid-plane of the boot and parallel to the heel part 26. This clamping device 52 in described in detail further below. For an understanding of FIGS. 1 and 2, it is sufficient to know that by pivoting the actuating element 58 to and fro within a working pivot range B (see FIG. 6) the clamping cables 56, 56' are intermittently wound onto the winding-up element 54. Then, by pivoting the actuating element 58 out of the working pivot range opposite to the winding-up direction, the winding-up element 54 can be released in order to loosen the clamping cables 56, 56'.

The clamping cable 56 extends from the winding-up element 54 to the orifice 50 and through the corresponding guide channel 48 to the guide orifice 46, from this to the respective guide eyelet 40 on the tongue part 28 and underneath the tongue part 28 to the passage 42, from where the clamping cable 56 extends on the outside of the tongue part 28 in the wave trough 30 over the instep/shin region to the passage 42 located opposite in relation to the longitudinal mid-plane of the boot. There, the clamping cable 56 once again penetrates through the tongue part 28 and extends underneath this to a fastening point 60 on the shell part 14, where this end of the clamping cable 56 is anchored firmly. The other clamping cable 56 extends accordingly from the clamping device 52 through the corresponding guide channel 48 to the guide orifice 46, from this to the guide eyelet 40 and underneath the tongue part 28 to the passage 44. Between the two passages 44. the clamping cable 56' extends parallel to the clamping cable 56 in the adjacent wave trough 30 and with this end is fastened to the shell part 14 at the fastening point 60' in a corresponding way. The two fastening points 60, 60' are located opposite one another in relation to the longitudinal midplane of the boot and, as seen in the longitudinal direction A of the boot, are arranged on the shell part 14 so as to be offset forwards relative to the guide orifices 46. When the tongue part 28 bears on the shell part 14, the fastening points 60, 60' are covered by this.

As indicated by broken lines in FIG. 2, the gap between the shell 10 and the wearer's foot is filled in a way known per se with a soft padded inshoe 62.

When the tongue part 28 is opened, as shown in FIG. 1, the ski boot can be entered. Solely by pivoting the actuating element 56 to and fro, the two clamping cables 56, 56' are now wound on to the winding-up element 54, with the result that the tongue part 28 is pulled in the direction of the sole 14. At the same time, the straps 34 pivot about the respective rivet 32' in the clockwise direction until the longitudinal extension of the straps 34 extends in the direction of the pockets 36. By a further tightening of the clamping cables 56, 56', the tongue part 28 is pushed forwards in the longitudinal direction A of the boot at the same time executing a pivot movement in the clockwise direction, with the result that the straps 34 slide deeper into the pockets 36. The front end region of that portion **28*a* of the tongue part 28 covering the instep is thereby held on the shell part 14 in a precisely defined way. When the tightening force in the clamping cables 56, 56' is increased further, the tongue part 28 is brought to bear flush on the shell part 14, with the guide eyelets 40 coming to rest in the region of the guide orifices 46 in the heel region 18 (see FIG. 2). Because the tongue part 28 is mounted freely in the longitudinal direction A of the boot and pivotably by means of the rivets 32, it can be matched to the anatomy of the wearer's foot or lower leg region as a result of the deformation of the shell part 14. At the same time, particularly the guidance of the clamping cables 56, 56' in the region of the tongue part 28 and the high clamping force of the clamping device 52 ensures the best possible matching of the shell 10 to the particular individual foot shape of the skier as a result of a cross-sectional variation of the ski boot in the region covered by the tongue part 28. The high tension achieved thereby in the clamping cables 56, 56' provides the saddle-shaped tongue part 28 in the region of the guide eyelets 40 with a virtual joint, thus serving for obtaining a snugger guidance of the portion 28*b* covering the lower shin region during the torsal flexing movement of the lower leg. Moreover, during this flexing movement as a result of the guidance of the clamping cables 56, 56' from the heel part 26 to the tongue part 28 above the joints 24, the heel part 26 is also pulled forwards in a pivoting movement, and in this situation too, this gives the skier a firm hold in the ski boot. It must be remembered that, when the ski boot is being closed, the clamping cables 56, 56' serve as guide strands for the positive closing movement of the tongue part 28**.

To open the ski boot, the actuating element 58 is brought outside the working pivot range opposite to the clamping direction, with the result that the winding-up element 54 is released. The high tension in the clamping cables 56, 56' is thereby reduced immediately and it becomes possible for the wound-up portion of the clamping cables 56, 56' to unwind during the forward pivoting of the tongue part 28. When the tongue part 28 is pivoting forwards in this way, the straps 34 slide rearwards in the pockets 36 in the longitudinal direction A of the boot, since the tongue part 28 rests with its front end against the shell part 14 in the region of the longitudinal mid-plane of the boot. The tongue part 28 is thereby brought into the position shown in FIG. 1.

A clamping device which is especially suitable for the ski boot described and can exert the necessary high tightening forces in the clamping cables 56, 56', without the wearer of the ski boot expending a large amount of force on the actuating element 58, but which nevertheless allows long lengths of the clamping cables 56, 56' to be wound up by means of only a few pivoting strokes of the actuating element 58, is now described in more detail below.

Figure 3:
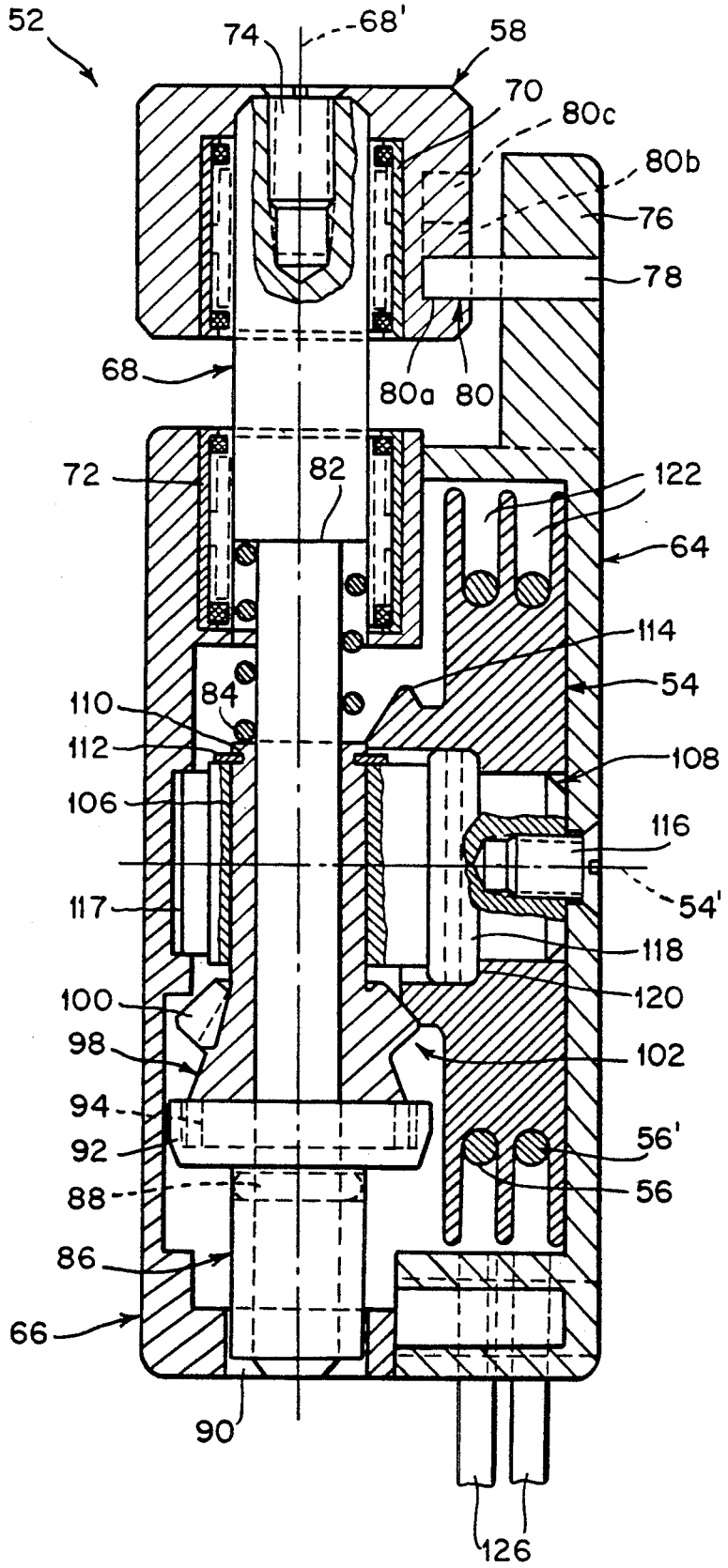
FIG. 3 shows a section view of a clamping device along line 3—3 of FIG. 2.
Figure 4:
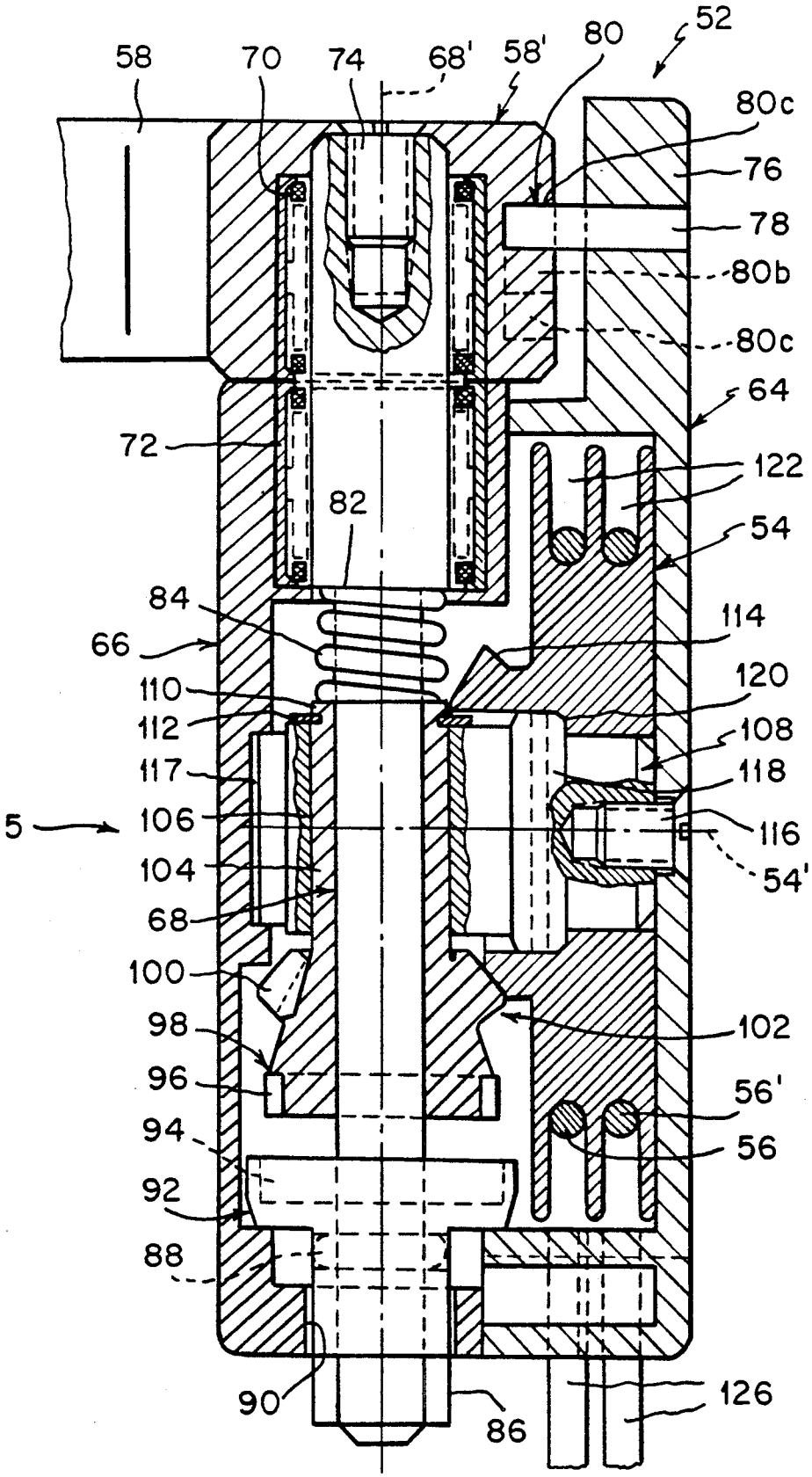
FIG. 4 shows a section view of a clamping device along line 4—4 of FIG. 1.
Figure 5:
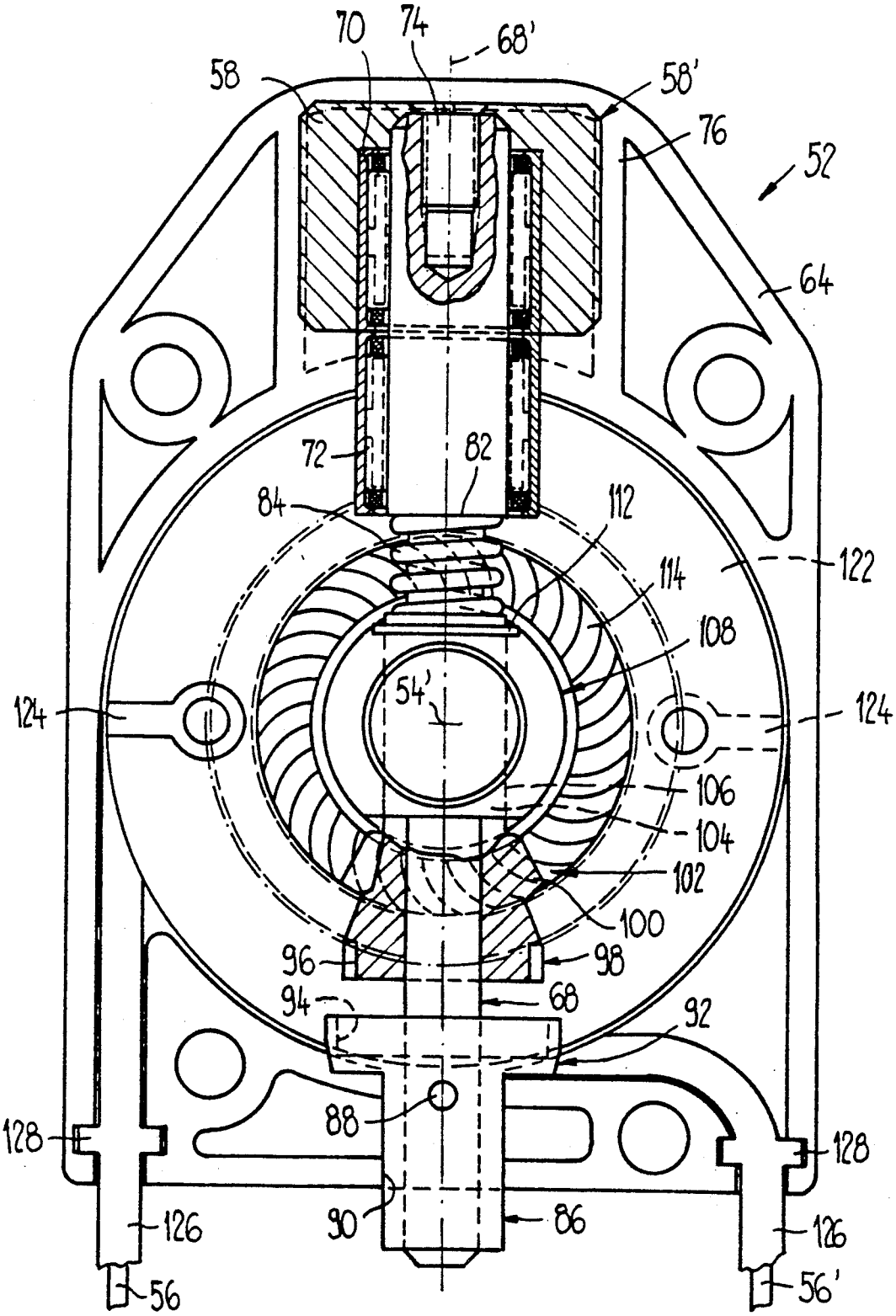
FIG. 5 shows a view of a clamping device in the direction of arrow 5 of FIG. 4.

The clamping device 52 illustrated in FIGS. 3–5 has a housing part 64 and a cover 66. The clamping device 52 bears with the housing part 64 on the heel part 26 of the ski boot and is fastened to this, for example, by means of screws (not shown). FIGS. 3 and 4 show the clamping device 52 in a section taken along line 3—3 of FIG. 2 or line 4—4 of FIG. 1, respectively. FIG. 5 shows a view of the clamping device 52 in the direction of the arrow 5 of FIG. 4, the cover 66 not being shown.

The actuating element 58 designed as a toggle is arranged on the upper end region of a shank 68, the longitudinal axis 68' of which intercepts the axis of rotation 54' of the winding-up element 54. The longitudinal axis 68' extends approximately in the longitudinal mid-plane of the boot and parallel to the heel part 26, whereas the axis of rotation 54' is essentially at right angles to the heel part 26 (see FIGS. 1 and 2).

The actuating element 58 is connected to the shank 68 via a freewheel sleeve 70 active in the clockwise direction. Moreover, the shank 68 is supported on the cover 66 via a further or second freewheel sleeve 72 active in the counterclockwise direction. The shank 68 is thus rotatable only in the counterclockwise direction (winding-up direction). By means of a screw 74 extending in the direction of the longitudinal axis 68', the cap-shaped actuating element 58 arranged on the upper end of the shank 68 is fixedly connected to the latter in terms of lifting. The housing part 64 has an extension 76 which projects upwards into the region of the actuating element 58 and on which is fixedly arranged a guide pin 78 projecting towards the actuating element 58. The guide pin 78 engages with its free end region into a slot-shaped groove 80 in the actuating element 58.

The layout of the groove 80 is shown in FIG. 6. The groove 80 has a lower groove part **80*a* extending circumferentially in relation to the longitudinal axis 68', an adjoining rising groove part 80*b* and a shorter groove part 80*c* which again extends circumferentially and which, at its end remote from the groove part 80*b*, is limited by a short downwardly directed catch part 80*d*. The lower groove part 80*a* defines a working pivot range B. When the actuating element 58 is pivoted in such a way that the guide pin 78 is located within the working pivot range B, the actuating element 58, together the shank 68, is lifted into an upper clamping position, as shown in FIG. 3. The actuating element 58 can thus be pivoted within the working pivot range B without the shank 68 being lowered in the direction of the longitudinal axis 68'**.

In contrast, when the actuating element 58 is pivoted out of the working pivot range B in the clockwise direction oppositely to the winding-up direction, the rising groove part B runs along the guide pin 78, as a result of which the actuating element 58, together with the shank 68, is displaced downwards in the direction of the longitudinal axis 68'. When the actuating element 58 is pivoted in the clockwise direction until the groove part 80c is located at the guide pin 78, then the actuating element 58, together with the shank 68, is lowered into the lower release position shown in FIGS. 4 and 5 and designated by 58'. It should be mentioned, in this respect, that the shank 68 is guided in the further freewheel sleeve 72 so as to be displaceable in the direction of the longitudinal axis 68', and that the actuating element 58 is freely pivotable in the clockwise direction, without taking up the shaft 68. When the actuating element 58 is pivoted until the catch part 80d is located at the guide pin 78, then the actuating element 58 is prevented from unintentionally pivoting in the counterclockwise direction. This is because the shank 68 is prestressed upwards as a result of the force of the compression spring 84 supported at one end on a step 82 of the shank 68, so that the catch part 80d is held in the guide pin 78.

In the lower end region of the shank 68, there is arranged on this a sleeve 86 which is connected to it fixedly in terms of rotation and of lifting by means of a peg 88 extending transversely through the sleeve 86 and the shank 68. The sleeve 86 passes through an orifice 90 in the cover 66. A hat-shaped upwardly open coupling part 92 with an internal toothing 94 is formed in one piece on the sleeve 68 at the upper end. When the shank 68 is in the clamping position there engages into this internal toothing 94 a corresponding external toothing 96 of a fixedly mounted gearwheel-shaped further coupling part 98, as shown in FIG. 3. When the actuating element 58 is in the release position 58' and consequently the shank 68 is displaced downwards, the coupling part 92 is moved out of the fixed coupling part 98, as shown in FIGS. 4 and 5.

A bevel wheel 100 of a bevel gear 102 and a tubular shaft part 104 are formed in one piece on the fixed coupling part 98 on the side located opposite the coupling part 92. The shank 68 thus extends freely rotatably through the coupling part 98, the bevel wheel 100 and the shaft part 104. The shaft part 104 passes through a bore 106 of a journal-like bearing part 108 extending in the direction of the axis of rotation 54' and intended for the winding-up element 54. In the upper free end region, the shaft part 104 has a circumferential groove 110, in which a spring ring 112 is arranged. The spring ring 112 is supported on the bearing part 108 in the direction of the longitudinal axis 68' and keeps the bevel wheel 100 in meshing engagement with a further bevel wheel 114 formed on the winding-up element 54. That the end of the compression spring 84 remote from the step 82 of the shank 68 is supported on the upper end of the shaft part 104.

The bearing part 108 is fastened to the housing part 64 by means of a screw 116 extending in the direction of the axis of rotation 54' and at the other end is supported in the cover 66 in a bearing recess 117 in the form of a blind hole. In the middle region between the bore 106 and that end of the shaft part 104 facing the housing part 64, the shaft part 104 has a continuous bead 118 projecting in the radial direction. The drum-shaped winding-up element 54 is arranged in the region between the housing part 64 and the bead 118 freely rotatably on the bearing part 108, the latter being held fixedly in the direction of the axis of rotation 54' by the housing part 64 and a step 120 bearing in the axial direction on the bead 118 and located on the winding-up element 54. The bevel wheel 114 is formed in one piece on the drum-shaped winding-up element 54 and projects relative to the drum-shaped part on the side facing away from the housing part 64.

The winding-up element 54 possesses, in the drum-shaped part, two continuous winding grooves 122 arranged next to one another and each intended for a clamping cable 56 and 56' respectively. The width of these winding grooves 122 in the axial direction is only insignificantly larger than the diameter of the clamping cables 56, 56', so that these are guided exactly in the region of the winding-up element 54 and portions of the clamping cables 56, 56' lying on one another are prevented from being jammed against one another. Furthermore, the winding-up element 54 possesses, in the region of the winding grooves 122, diametrically opposed radial slots 124 which are each assigned to a winding groove 122 and which, in their inner end region, as seen in the radial direction, have a wider section, in which the ends of the respective clamping cables 56, 56' are held in a known way by means of an end nipple. In the region between the guide orifices 46 (see FIGS. 1 and 2) and the winding grooves 122, the clamping cables 56, 56' are guided in tubular guide sleeves 126. These posses, in the end region on the same side as the clamping device, thicker sections 128 (FIG. 5), by means of which they are held in corresponding recesses in the housing part 64.

FIG. 7 illustrates a clamping device 52 similar to that in FIGS. 3 to 5, but in which the bevel gear 102 itself is designed as a coupling between the shank 68 and the winding-up element 54. Since the guidance of the actuating element 58 on the extension 76 of the housing part 64, the coupling between the actuating element 58 and the shank 68 and the support of the shank 68 on the cover 66 are of a construction identical to that of the clamping device 52 illustrated in FIGS. 3 to 5. These parts are not shown again in FIG. 7. The bearing part 108 and the winding-up element 54 mounted freely rotatably on this are also not described in more detail again for the same reasons. The bevel wheel 100' formed in one piece with the tubular shaft part 104 is arranged on the shank 68 and is connected to this fixedly in terms of rotation and of lifting by means of a peg 88'. The shaft part 104 is guided so as to be freely rotatable in the bore 106 and displaceable in the direction of the longitudinal axis 68'. Supported on the bevel wheel 100' is a compression spring 84' which surrounds the shank 68 and which is supported at the other end on the cover 66. This compression spring 84' presses the bevel wheel 100' against the bevel wheel 114' formed on the winding-up element 54. When the actuating element 58 is in the working pivot range B (see FIGS. 3–6), the bevel wheel 100' is in the position shown in FIG. 7, in which it means with the bevel wheel 114'. In contrast, when the actuating element 58 is pivoted in such a way that the groove part 80c is located at the guide pin 78, as a result of the movement of the shank 68 in the direction of its longitudinal axis 68' the bevel wheel 100' is brought out of engagement with the bevel wheel 114' counter to the force of the compression spring 84'. With the same choice of material for the bevel wheels 100, 114, 100' 114' in the two illustrated embodiments of the clamping device 52, higher tensile forces in the clamping cable 56, 56' are possible in the embodiment according to FIGS. 3–5. This is by means of a claw coupling or, as shown in these figures, a toothed coupling higher torques can be disconnected in comparison with the intermeshing of the level wheels 114, without damaging the respective toothings, because, where the latter are concerned, a single toothed flank has to support the entire torque whenever disconnection takes place.

The clamping device 52 function as follows. With the ski boot opened and the clamping device 52 released, the actuating element 58 is pivoted in the clockwise direction outside the working pivot range B, so that the catch part 80d of the groove 80 is located at the guide pin 78. The shank 68 of the actuating element 58 are lowered into the release position 58', as shown in FIGS. 4 and 5. At the same time, the coupling between the coupling parts 92 and 98 or between the two bevel wheels 100' and 114' according to FIG. 7 is released. The winding-up element 54 is freely rotatable (FIG. 4). For rolling up and tightening the clamping cables 56, 56', the actuating element 58 is now pivoted in the counterclockwise direction (winding-up direction) out of the catch part **80*d* into the working pivot range B (see FIG. 6). The actuating element 58, together with the shank 68, thus moves into the upper clamping position according to FIGS. 3 and 7. At the same time, the two coupling parts 92, 98 or the two bevel wheels 100' 114' come into engagement with one another. By rotating the actuating element 58 to and fro within the working pivot range B, the shank 68 is now taken up whenever the actuating element 58 is rotated counterclockwise in the winding-up direction. The rotation of the shank 68 produced thereby is transmitted to the winding-up element 54 via the bevel gear 102, with the result that the clamping cables 56, 56' are wound up intermittently in each case (FIG. 3). The freewheel sleeve 72 at the same time prevents the shank 68 from rotating in the clockwise direction and thus also prevents the clamping cables 56, 56' from unwinding from the winding-up element 54. By an appropriate rotation of the actuating element 58, the desired tensile force can now be built up continuously in the clamping cables 56, 56'. As soon as the desired tensile force is reached in the clamping cables 56, 56', that is to say as soon as the ski boot according to FIGS. 1 and 2 rests flush against the foot, the actuating element 58** is left in the particular position.

When the clamping cables 56, 56' have to be loosened, the actuating element 58 is briefly rotated clockwise in the opposite direction to the winding-up direction, so that the two coupling parts 92, 98 (FIG. 4) or bevel wheels 100', 114' (FIG. 7) briefly come out of engagement. By means of the tensile force in the clamping cables 56, 56', these are now unwound partially from the winding-up element 54. By subsequently rotating the actuating element 58 back into the working pivot range B, the winding-up element 54 is blocked again. To open the ski boot, the actuating element 58 is rotated out of the working pivot range B, in such a way that the groove part **80*c* or the catch part 80*d* comes to rest at the guide pin 78. The winding-up element 54 is thus released in a similar way, so that by pivoting the tongue part 28 forward (see FIGS. 1 and 2) the clamping cables 56, 56' can then be unwound to the necessary length from the winding-up element 54**.

With the clamping devices 52 shown in FIGS. 3–7, winding-up elements 54 of large diameter can be accommodated in a small housing part 64 with a cover 66. The result of this is that long lengths of clamping cables 56, 56' can be wound up by means of only a few revolutions of the winding-up element 54. Nevertheless, high tensile forces can easily be obtained in the clamping cables 56, 56' as a result of the constant force/path relations and the ergonomic arrangement of the actuating element 58. Only a single actuating element 58 is needed for the tensioning and quick release of the clamping device 52, and this considerably increases the ease of operation.

It is also possible to wind up the two end portions of the same cable-like clamping element in the two winding grooves. Of course, the clamping device according to the invention can also be used for actuating foot-retaining devices provided inside the ski boot.

While only two embodiments of the present invention has been shown and described, it is to be understood that many changes and modifications may be made thereunto without departing from the spirit and scope of the invention as defined in the appended claims.

What is claimed is:

1. A ski boot comprising:

a shell part having a toe/instep region and an instep/-shin region and equipped with a sole;

a heel part mounted on the shell part so as to be forwardly pivotable out of a position of rest about an axis extending essentially parallel to the sole, said heel part articulated on the shell part in the region of the heel bone;

in said position of rest, said heel part being forwardly inclined;

a tongue part which is articulated on the shell part in the toe/instep region and which is forwardly pivotable for entry into and exit from the ski boot and which covers the shell part in the instep/shin region;

a cable-like clamping element extending over the tongue part;

a clamping device fore the releasable clamping of said clamping element;

a guide and a guide element;

said clamping element extending on both sides of the ski boot from said guide located on the heel part above its point of articulation on the shell part to said guide element, said guide element being on the tongue part in the lateral end regions of the latter at the transition between the instep region and the shin region;

said ski boot being closed by clamping the clamping element;

said ski boot being a front-entry ski boot;

said boot having a longitudinal direction;

wherein the tongue part is guided on the shell part, in the toe/instep region, so as to be displaceable essentially in said longitudinal direction of the boot, and is mounted pivotably about an axis extending transversely relative to the longitudinal direction of the boot and approximately parallel to the sole;

wherein the tongue part has two lateral front end regions and wherein said toe/instep region has a pocket adjacent to said two lateral front end regions;

a strap upon which said tongue part is mounted pivotably, in each of said two lateral front end regions;

said strap guided on the shell part, with its longitudinal extension extending essentially in the longitudinal direction of the boot, so as to be displaceable approximately in the longitudinal direction of the boot, so that said strap is receivable into said pocket;

wherein the tongue part has a rear end position; and whenever the tongue part is in said rear end position, the strap is pivotable about an axis extending transversely relative to the longitudinal direction of the boot and essentially parallel to the sole.

2. The ski boot as claimed in claim 1, wherein the clamping device is provided on the heel part, and the clamping element emerges from the heel part at the guide.

3. The ski boot as claimed in claim 1, further comprising passages fro the clamping element;

said passages being provided in the tongue part approximately centrally, on both sides between the guide element and the longitudinal mid-plane of the boot; and the clamping element extends from the guide elements as far as the corresponding passages under the tongue part and, between the passages.

4. The ski boot as claimed in claim 1, wherein the clamping element comprises two clamping members which are connected operatively to a common clamping device and which extend on one side of the ski boot from the guide to the guide element and at least partially over the tongue part onto the other side of the ski boot to a fastening point provided on the shell part.

5. The ski boot as claimed in claim 4, wherein the fastening points are offset relative to the guides towards the boot tip in the longitudinal direction of the boot.

6. The ski boot as claimed in claim 4, further comprising passages for each clamping member being provided in the tongue part, approximately centrally, on both side between the guide element and the longitudinal mid-plane of the boot; and said clamping member extending from the guide element as far as the corresponding passages under the tongue part and, between the passages.

7. The ski boot as claimed in claim 6, wherein said passages are provided on each side for the clamping member and are offset relative to one another in the longitudinal direction of the boot; and in the region between the passages each clamping member is spaced from the other in the longitudinal direction of the boot and extends essentially parallel to one another.

8. The ski boot as claimed in claim 1, wherein the tongue part is wave-shaped, having a wave trough in the region of the clamping element; and the clamping element or each clamping member extends in said wave trough.

9. The ski boot as claimed in claim 1, said clamping device having a rotatably mounted winding-up element for the winding up direction and unwinding direction of the clamping element;

a transmission member supported by a first freewheel acting in the winding up direction;

an actuating element pivotable by hand in both directions;

a counteracting second freewheel for connecting the actuating element to the transmission member; and a coupling actuable from outside the clamping device and for the releasable connection of the transmission member to the winding-up element.

10. The ski boot as claimed in claim 1, further comprising a clamping device for a ski boot which comprises:

a clamping element;

a rotatably mounted winding-up element for the winding-up and unwinding of said clamping element;

an actuating element pivotable to and fro within a working pivot range for the intermittent driving of the winding-up element in the winding-up direction;

a take-up connection rotatable in the winding-up direction for connecting said actuating element to a transmission member;

a return catch device for preventing said transmission member from rotating oppositely to the winding-up direction;

a coupling for connecting the transmission member to the winding-up element and controllable as a result of the displacement of the transmission member;

said transmission member being displaceable as a result of a pivoting of the actuating member for the purpose of releasing the coupling;

a slot-shaped groove;

said actuating element during the pivoting out of the working pivot range oppositely to the winding-up direction, is movable by said slot-shaped groove in the direction of its pivot axis; and said transmission member being displaceable as a result of this movement of the actuating element in the direction of its pivotal axis for the release of the coupling.

11. A ski boot comprising a shell part having a toe/instep region and an instep/shin region and equipped with a sole;

a heel part mounted on the shell part so as to be forwardly pivotable out of a position of rest about an axis extending essentially parallel to the sole, said heel part articulated on the shell part in the region of the heel bone;

in said position of rest said heel part being forwardly inclined;

a tongue part which is articulated on the shell part in the toe/instep region and which is forwardly pivotable for entry into and exit from the ski boot and which covers the shell part in the instep/shin region;

a cable-like clamping element extending over the tongue part;

a clamping device for the releasable clamping of said clamping element;

a guide and a guide element;

said clamping element extending from said guide located above the point of articulation of the heel part on the shell part to said guide element, said guide element being on the tongue part in the lateral end regions of the latter at the transition between the instep region and shin region;

said ski boot being a front-entry ski boot;

said boot having a longitudinal direction;

the tongue part being guided on the shell part, in the toe/instep region, so as to be displaceable essentially in said longitudinal direction of the boot, and being mounted pivotably about an axis extending transversely relative to the longitudinal direction of the boot and approximately parallel to the sole;

the tongue part comprising two lateral front end regions;

said toe/instep region being connected to guiding means adjacent to said two lateral front end regions;

said tongue part being mounted pivotably in each of said two lateral front end regions at said guide means;

the tongue part having a front end position and a rear position; and said guide means comprising longitudinal extensions for guiding the lateral front end regions of the tongue part so that the tongue part is displaceable from the front end position to the rear end position approximately in the longitudinal direction of the boot and in the rear end position being pivotable about the axis extending transversely relative to the longitudinal direction of the boot and essentially parallel to the sole.

* * * * *